US006109900A

United States Patent [19]

Ishizuka et al.

[11] Patent Number: 6,109,900

[45] Date of Patent: Aug. 29, 2000

[54] HYDRAULIC PUMP

[75] Inventors: Atsushi Ishizuka; Sachiko Nojyo, both of Kanagawa, Japan

[73] Assignee: Unisia Jecs Corporation, Atsugi, Japan

[21] Appl. No.: 09/090,970

[22] Filed: Jun. 5, 1998

[30] Foreign Application Priority Data

Jun. 24, 1997 [JP] Japan ..... 9-181873

[51] Int. Cl.[7] ..... F01C 21/04

[52] U.S. Cl. ..... 418/102; 418/94

[58] Field of Search ..... 418/102, 94

[56] References Cited

U.S. PATENT DOCUMENTS

| | | | |
|---|---|---|---|
| 2,516,589 | 7/1950 | Pond et al. | 418/102 |
| 3,272,138 | 9/1966 | Connoy et al. | 418/102 X |
| 4,501,536 | 2/1985 | Middlekauff | 418/102 X |
| 4,770,616 | 9/1988 | Kahrs | 418/102 X |
| 5,083,909 | 1/1992 | Kunsemiller et al. | 418/102 |

FOREIGN PATENT DOCUMENTS

| | | | |
|---|---|---|---|
| 0069786 | 3/1989 | Japan | 418/102 |
| 7-279871 | 10/1995 | Japan . | |

*Primary Examiner*—Hoang Nguyen
*Attorney, Agent, or Firm*—Foley & Lardner

[57] ABSTRACT

A hydraulic pump unit is encased between a pump body and a pump cover. A bearing hole passes through the pump body and is formed in the pump body. A drive shaft and a bearing bush are inserted into the bearing hole. The drive shaft drives the hydraulic pump unit and the bearing bush supports the drive shaft. At an end portion of the bearing hole, a seal chamber is formed. The seal chamber encases a seal member. An oil groove is formed inside the bearing hole. The oil groove connects the hydraulic pump unit side with the seal chamber and carries hydraulic oil for lubrication. The oil groove is formed in such a manner that a sectional area in the seal chamber side is greater than a sectional area in the hydraulic pump unit side. The bearing bush comprises a plurality of bush pieces arranged at a predetermined interval in an axial direction of the bearing hole.

17 Claims, 5 Drawing Sheets

HYDRAULIC PUMP

BACKGROUND OF THE INVENTION

The present invention relates to a satisfactory hydraulic pump used as a power source such as a power source of a power steering of automobiles.

As such a hydraulic pump, Japanese Unexamined (KOKAI) Patent Publication No. 7 (1995)-279871 discloses a hydraulic pump in which a hydraulic pump unit is encased between a pump body and a pump cover, a bearing bush is inserted into a bearing hole, the bearing hole passes through the pump body and is formed in the pump body, the bearing bush supports a drive shaft for driving the hydraulic pump unit and a seal chamber is formed at the end portion of the bearing hole.

At the inner circumference side of the cylindrical bearing bush inserted into the bearing hole of the pump body, one streak of an oil groove is spirally formed. The oil groove opens toward both end portions of the bearing bush. The hydraulic oil leaked in the hydraulic pump unit side is led to the seal chamber through the oil groove.

In such a conventional example, the hydraulic pump unit is driven by the drive shaft supported by the bearing bush. That is, a pulley is installed on the end portion of the drive shaft projecting from the pump body and the drive shaft is driven and rotated by a belt wound on the pulley and thereby the function of the hydraulic pump is performed.

At this time, when the hydraulic pump unit is driven, oil is leaked from the hydraulic pump unit. This leakage oil is led from the bearing hole into the inside of the oil groove of the bearing bush. The hydraulic oil flowing inside the oil groove of the bearing bush is led into the seal chamber with lubricating between the bearing bush and the drive shaft. The lubrication between the bearing bush and the drive shaft is performed in such a manner that a moderate supporting gap is formed between the bearing bush and the drive shaft, lubricating oil is supplied from the oil groove into the supporting gap, oil film is formed by the rotation of the drive shaft, the oil film supports the drive shaft and the direct contact of metals between the drive shaft and the bearing bush is prevented.

The hydraulic oil led from the oil groove into the inside of the seal chamber is sealed by a seal member encased in the seal chamber.

However, in the conventional example, the oil groove having a constant sectional area is formed at the inner circumference side of the bearing bush. Thus, when the quantity of the leakage oil in the hydraulic pump unit side increases, the flow speed of the hydraulic oil flowing inside the oil groove becomes faster, and the hydraulic oil having a faster flow speed is led into the seal chamber. When the hydraulic oil having the faster flow speed in the oil groove acts on the seal member in the seal chamber, if the hydraulic oil has the energy which exceeds the sealing ability of the seal member, it is apprehended that the hydraulic oil leaks to the outside.

SUMMARY OF THE INVENTION

It is therefore an object of the present invention to provide a hydraulic pump which can prevent hydraulic oil from leaking to the outside.

According to the present invention, a hydraulic pump comprises:

a pump body formed with a bearing hole passing through the pump body;

a pump cover;

a hydraulic pump unit encased between the pump body and the pump cover;

a drive shaft, inserted into the bearing hole, for driving the hydraulic pump unit;

a bearing bush, inserted into the bearing hole, for supporting the drive shaft;

a seal member encased in a seal chamber formed at an end portion of the bearing hole; and an oil groove, formed in the bearing hole, for connecting a hydraulic pump unit's side with the seal chamber and for carrying hydraulic oil for lubrication;

wherein a sectional area of the oil groove is greater on the seal chamber's side than on the hydraulic pump unit's side and wherein the bearing bush comprises a plurality of bush pieces arranged at a predetermined interval in an axial direction of the bearing hole.

In another embodiment, an oil groove may be formed in an inner circumference surface of the bearing bush for connecting a hydraulic pump unit's side with the seal chamber and for allowing hydraulic oil for lubrication.

In still another embodiment, the bearing bush comprises a plate shape member rounded into a cylindrical shape and the plate member comprises a gap forming an oil groove for connecting the hydraulic pump unit's side with the seal chamber and for carrying hydraulic oil for lubrication.

The hydraulic pump includes a vane pump, a plunger pump, a piston pump and includes various liquid pumps regardless of the form.

In the above-mentioned composition, the hydraulic pump functions as a pump when the drive shaft is driven and the hydraulic pump unit is driven.

DETAILED DESCRIPTION OF THE INVENTION

Figure 1:
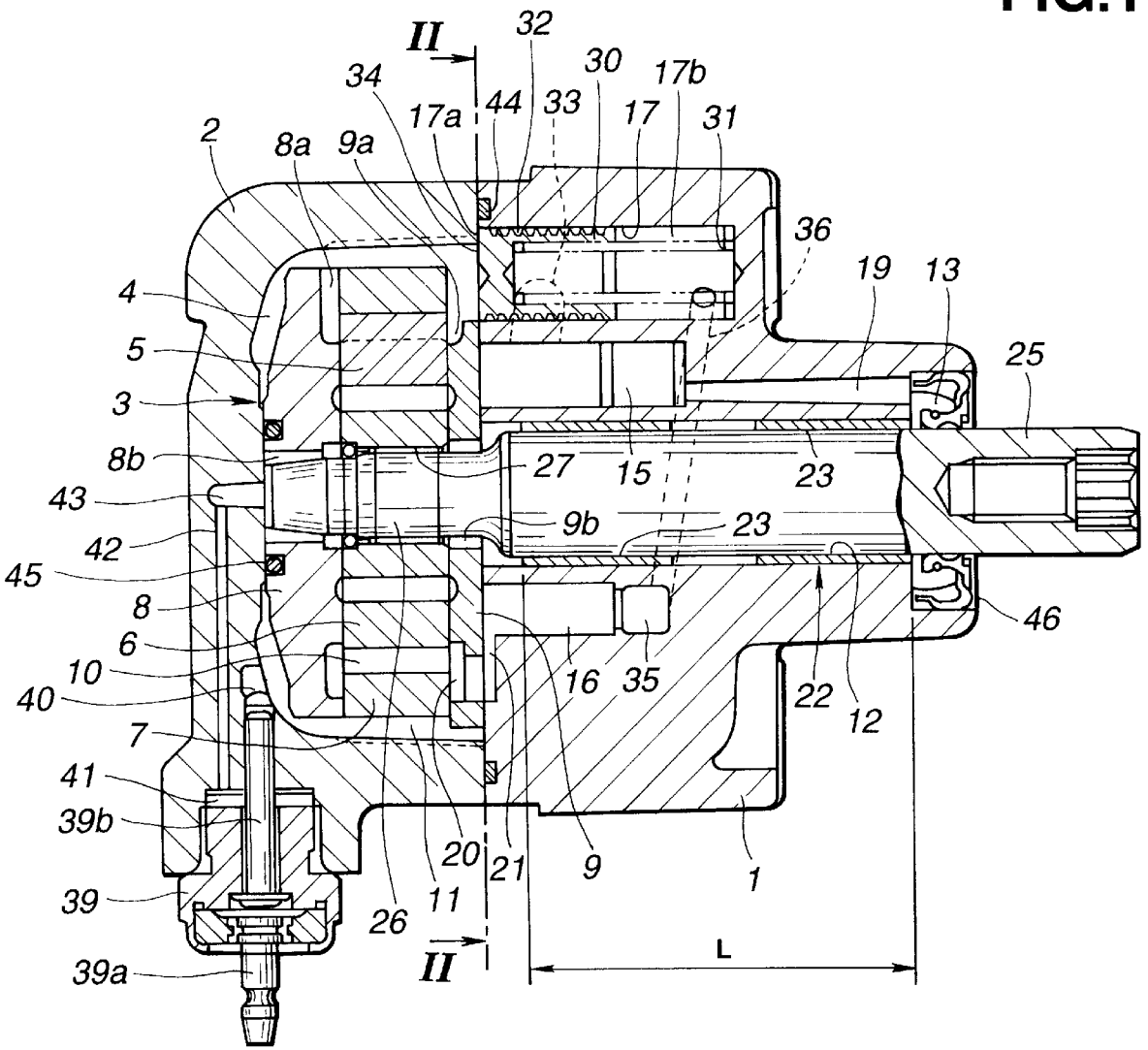
FIG. 1 is a sectional view showing an embodiment of hydraulic pump of the present invention.

The following is an explanation of one embodiment applied to a hydraulic pump of a power steering of the present invention with reference to the drawings.

In the drawings, a reference numeral 1 denotes a pump body made of metallic materials such as aluminum alloy and so on and a reference numeral 2 denotes a pump cover made of metallic materials. The pump body 1 and the pump cover 2 encase a hydraulic pump unit 3. That is, an annular concave portion 4 is formed between the pump body 1 and the pump cover 2. The hydraulic pump unit 3 is installed in the annular concave portion 4.

In this embodiment, the hydraulic pump unit 3 is a vane hydraulic pump unit. The hydraulic pump unit 3 includes a cam ring 7 encasing a rotor 6. The rotor 6 comprises a plurality of vanes 5 which are radially movable in and out. Both sides of the cam ring 7 are guided by side plates 8 and 9. A pumping chamber 10 is formed by two adjacent one of the vanes 5 between the cam ring 7 and the rotor 6. The volume of the pumping chamber 10 varies by the rotation of the rotor 6. With this variation, an inhaling zone is formed in a portion increasing in volume and a discharging zone is formed in a portion decreasing in volume. Notch passages 8*a* and 8*b* are formed in the side plates 8 and 9. The side plates 8 and 9 face the discharging zone. The notch passages 8*a* and 9*a* open radially and outwardly. The oil discharged from the pump is discharged into a discharging chamber (a high pressure chamber) 11 of the annular concave portion 4 of the outer circumference of the cam ring 7. An inhaling port not shown in the drawing is formed in the side plate 9 facing the inhaling zone and passes therethrough.

A bearing hole 12 is formed in the pump body 1 and passes through the pump body 1. A seal chamber 13 is formed in an end portion of the bearing hole 12.

Figure 2:
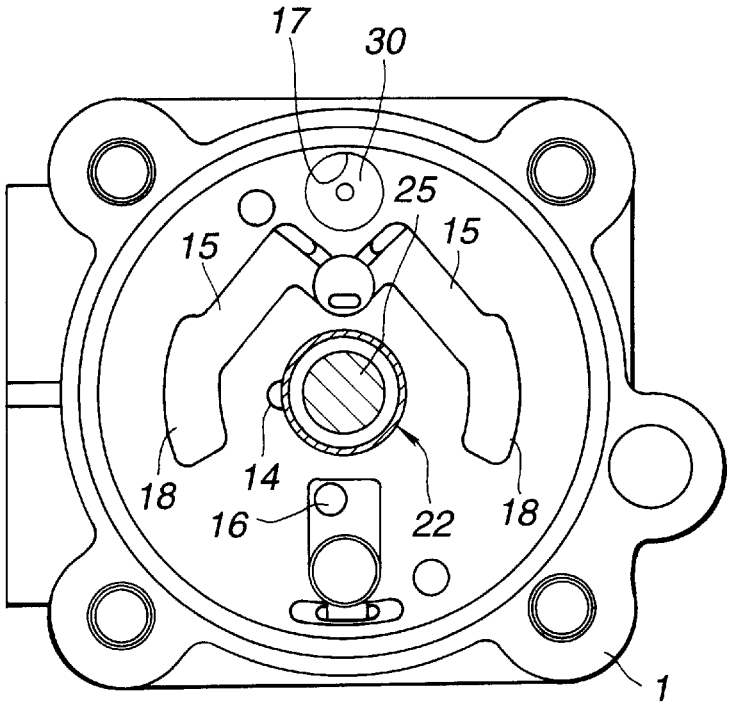
FIG. 2 is a sectional view taken across a line II—II of FIG. 1.

An oil groove 14 communicating from the hydraulic pump unit 3 side to the seal chamber 13 is formed in the bearing hole 12. (Refer to FIGS. 2 and 4). The section of the oil groove 14 is a circular arc. The oil groove 14 is formed in a substantially straight line shape in an axial direction of the bearing hole 12 and is formed in a taper shape converging into a substantially center position of the bearing hole 12 from the hydraulic pump unit 3 side and the seal chamber 13 side. With this, the sectional area of the oil groove 14 in the seal chamber 13 side is greater than the sectional area of the oil groove 14 in the hydraulic pump unit 3 side and it is easy to form the oil groove 14 in a casting mold.

The oil groove 14 in this embodiment is divided at a substantially center position of the bearing hole 12. However, because the substantially center position of the bearing hole 12 is positioned between a plurality of bush pieces later-mentioned, the substantially center position of the bearing hole 12 is substantially communicated with an interval between the bush pieces. Because the oil groove 14 is divided at the substantially center position of the bearing hole 12, this divided part becomes a so-called labyrinth and a flow resistance is applied to hydraulic oil flowing in the oil groove 14. Therefore, it is possible to decrease the energy of the hydraulic oil flowing into the seal chamber 13.

Figure 5:
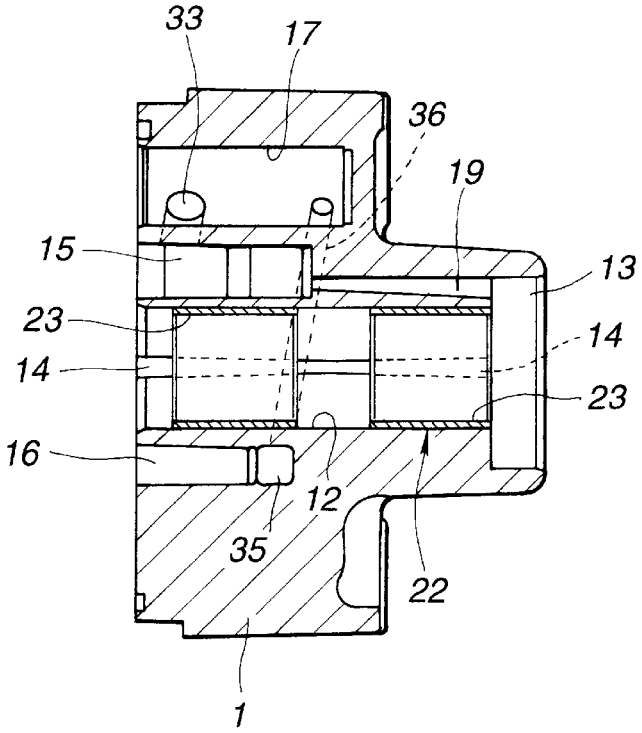
FIG. 5 is a view, similar to FIG. 4, showing other embodiment of an oil groove formed in the bearing hole.
Figure 6:
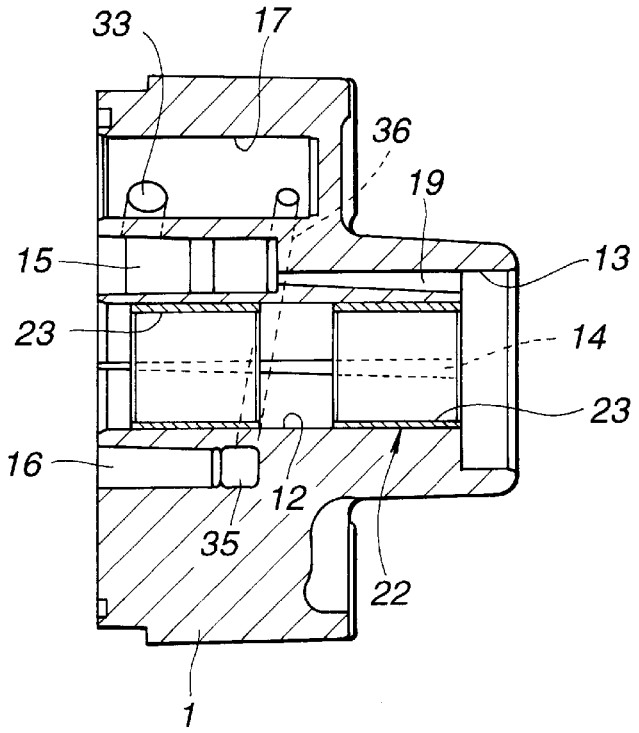
FIG. 6 is a view, similar to FIG. 4, showing another embodiment of the oil groove formed in the bearing hole.

The oil groove 14 can be continuously formed without dividing at the substantially center position of the bearing hole 12 as shown in FIG. 5. The oil groove 14 can be continuously formed in a taper shape so that the sectional area increases gradually from the hydraulic pump unit 3 side to the seal chamber 13 side as shown in FIG. 6.

With this structure, the oil groove 14 can lead the leakage oil from the bearing hole 12 of the hydraulic pump unit 3 to the seal chamber 13. The leakage oil from the hydraulic pump unit 3 is the hydraulic oil leaking between the rotor 6 and the side plates 8 and 9 and is a little hydraulic oil leaking from the joint between the pump body 1 and the side plate 9.

An inhaling passage 15, a discharging passage 16 and a spool valve receiving bore 17 are formed in the pump body 1. The inhaling passage 15 connects each pumping chamber 10 of the inhaling zone with a storage tank not shown in the drawing. The discharging passage 16 connects each pumping chamber 10 of the discharging zone with the actuator of the power steering not shown in the drawing. One end of the spool valve receiving bore 17 is sealed.

The inhaling passage 15 is branched into two directions at the joint facing the side plate 9. At the end portion of the inhaling passage 15, a circular arc shape inhaling port 18 is formed. The inhaling port 18 is formed so that the inhaling port 18 faces the inhaling port, not shown in the drawing, formed in the side plate 9. The inhaling passage 15 is connected with the seal chamber 13 through a low pressure passage 19. The low pressure passage 19 is substantially parallel with the bearing hole 12. (Refer to FIG. 2)

The discharging passage 16 is bent radially and outwardly at the joint facing the side plate 9. An orifice passage 21 connected with an inhaling port 20 formed in the side plate 9 is formed in the discharging passage 16.

Figure 3:
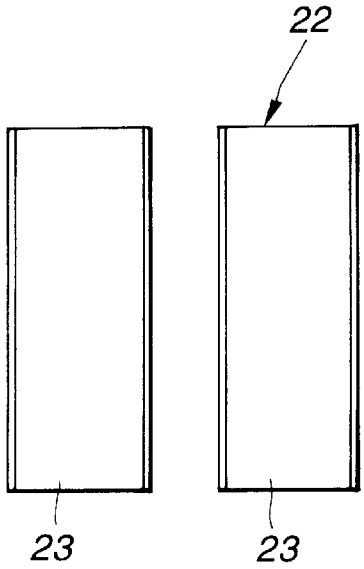
FIG. 3 is a view showing a bearing bush in an expanded state.

A reference numeral 22 denotes a bearing bush inserted into the bearing hole 12. The bearing bush 22 comprises a plurality of bush pieces 23 positioned at a predetermined interval in the axial direction of the bearing hole 12. In this embodiment, the bearing bush 22 comprises two bush pieces 23 positioned at the interval 1 in the axial direction of the bearing hole 12. The bush piece 23 is formed into a cylindrical shape by rounding a plate member. The inner surface of the bearing bush 22 is smooth. The oil groove is not formed in the bearing bush 22. (Refer to FIG. 3).

The interval 1 between the two-bush pieces 23 forming the bearing bush 22 is preferable to be substantially ⅓ of the axial length L of the bearing bush 22 in order to secure the area for supporting the bearing bush 22. In this embodiment, the interval 1 between the bush pieces 23 is substantially ⅕ of the axial length L of the bearing bush 22.

A reference numeral 25 denotes a drive shaft for driving the hydraulic pump unit 3. The drive shaft 25 is inserted into the bearing hole 12 in such a manner that the drive shaft 25 is supported by the bearing bush 22. The drive shaft 25 has serrations 26 formed near the forward end. The serrations 26 pass through the through hole 9*b* of the side plate 9 and are fitted in the serration hole 27 of the rotor 6. With this, the drive shaft 25 is capable of driving the rotor 6 of the hydraulic pump unit 3. The forward end portion of the drive shaft 25 is tapered and loosely fitted in the through hole 8*b* of the side plate 8.

A spool valve 30 controlling the quantity of the oil is slidably movable and is fitted in the spool valve receiving bore 17. The spool valve 30 divides the inside of the spool valve receiving bore 17 into a first pressure chamber 17*a* and a second pressure chamber 17*b*. The spool valve 30 is normally biased toward the first pressure chamber 17*a* side by a spring force of a control spring 31. The control spring 31 is encased in the second pressure chamber 17*b*. The spool valve 30 closes a drain passage 33 connecting the inhaling passage 15 by a land portion 32 in a normal condition. The opening end of the first pressure chamber 17*a* divided by the spool valve 30 faces the discharging chamber 11 and forms a leading passage 34 leading discharged oil of the pump.

In the pump body 1, a passage 35 is formed. The passage 35 is connected with a discharging lot not shown in the drawing in order to connect with the discharging passage 16 and to lead hydraulic oil to the power steering, that is, the actuator not shown in the drawing. The passage 35 is connected with the second pressure chamber 17*b* through a passage 36. The pressure in the discharging passage 16 is led into the second pressure chamber 17*b*.

A reference numeral 39 denotes a pressure switch mounted on the pump cover 2. The pressure switch 39 comprises a fixed contact 39*a* and a moving contact 39*b*. The pressure switch 39 is able to operate according to the pressure of the discharging chamber 11 because the end portion of the moving contact 39*b* faces a passage 40 connecting with the discharging chamber 11. The pressure switch 39 is thrust into and fixed in the inside of a concave portion 41. The inside of the concave portion 41 is connected with the through hole 9*b* of the side plate 9 through a radial passage 42 and an axial passage 43.

The pump body 1 and the pump cover 2 are connected and fixed with each other by bolts not shown in the drawing. The joint between the pump body 1 and the pump cover 2 is sealed by a seal ring 44 so as to prevent the hydraulic oil discharged into the discharging chamber 11 from leaking to the outside.

A reference numeral 45 denotes a seal ring installed between the pump cover 2 and the side plate 8. The seal ring 45 separates the discharging chamber 11 from the through hole 8*b* of the side plate 8. A reference numeral 46 denotes a seal member. The seal member 46 is installed in the seal chamber 13 and seals the drive shaft 25.

A driving means such as a pulley rotationally driven by an internal combustion engine not shown in the drawing is connected with the projecting end portion of the drive shaft 25 projecting from the pump body 1.

With this structure, the drive shaft 25 is rotationally driven through the pulley not shown in the drawing and the rotor 6 connected with the drive shaft 25 is rotationally driven. When the rotor 6 is rotationally driven, with the rotation of the rotor 6, the volume of the inhaling zone increases and the volume of the discharging zone decreases. Hydraulic oil is inhaled from the inhaling passage 15 through the inhaling port 18 into the pumping chamber 10 in the inhaling zone, passes through the pump and is discharged from the pumping chamber 10 in the discharging zone into the discharging chamber 11. The hydraulic oil discharged into the discharging chamber 11 is led to the first pressure chamber 17*a* through the leading passage 34. The hydraulic oil led into the first pressure chamber 17*a* is led into the actuator of the power steering not shown in the drawing through the orifice passage 21, the discharging passage 16 and the passage 35.

In a normal condition shown in FIG. 1, the spool valve 30 is urged toward the first pressure chamber 17*a* side by the control spring 31 and closes the drain passage 33 by the land portion 32 of the main body of the spool valve 30. All of the discharged oil led into the first pressure chamber 17*a* is led into the actuator not shown in the drawing through the orifice passage 21. When the rotational speed of the pump increases, the quantity of the oil discharged from the pump increases and the quantity of the oil discharged from the pump led into the first pressure chamber 17*a* increases, the hydraulic oil in the first pressure chamber 17*a* is led into the discharging passage 16 under the limitation of flow by the orifice passage 21, the spool valve 30 moves rightward and compresses the control spring 31 to a predetermined length according to the front and rear differential pressure of the orifice passage 21, opens the drain passage 33 and returns surplus oil from the drain passage 33 to the inhaling passage 15 and the storage tank not shown in the drawing.

With this, the quantity of the hydraulic oil led into the power steering not shown in the drawing through the inhaling passage 16 and the passage 35 is limited to a predetermined quantity.

As the hydraulic pump unit 3 is driven, the hydraulic oil is discharged into the discharging chamber 11 and leaks from a gap formed among the rotor 6 and the side plates 8 and 9 for lubrication. A small amount of the hydraulic oil also leaks from the joint between the pump body 1 and the side plate 9.

The leakage oil from the hydraulic pump unit 3 is collected into the bearing hole 12 of the hydraulic pump unit 3 side. That is, the leakage oil from the joint between the rotor 6 and the side plate 9 is led into the through hole 8*b* and is collected into the bearing hole 12 through the engaging gaps of the serrations 26 and 27 and the through hole 9*b* of the side plate 9. The leakage oil from the joint between the rotor 6 and the side plate 9 is collected into the bearing hole 12 through the through hole 9*b* of the side plate 9. The oil collected into the bearing hole 12 of the side plate 9 lubricates the bearing hole 12 and is led into the seal chamber 13 through the oil groove 14 formed in the bearing hole 12. The hydraulic oil led to the seal chamber 13 is sealed by the seal member 46 in the seal chamber 13 and is returned to the inhaling passage 15 and the storage tank not shown in the drawing through the low pressure passage 19.

At this time, the leakage oil led into the bearing hole 12 from the hydraulic pump unit 3 is directly supplied from the bearing hole 12 of the hydraulic pump unit 3 side into the inner surface of the bearing bush 22, is led into the seal chamber 13 through the oil groove 14 formed in the bearing hole 12 and is supplied from the seal chamber 13 side into the inner surface of the bearing bush 22. Because a part of the leakage oil led along the oil groove 14 is supplied from the oil groove 14 to spaces neighboring one another, the part of the leakage oil is supplied from the spaces between the bush pieces 23 into the inner surface of the bearing bush 22.

To be precise, the leakage oil from the hydraulic pump unit 3 is directly supplied from the inside of the bearing hole 12 of the hydraulic pump unit 3 side to the inner surface of the bush pieces 23 arranged at the hydraulic pump unit 3 side and is supplied from the seal chamber 13 side to the inner surface of the bush pieces 23 arranged at the seal chamber 13 side. A part of the leakage oil led along the oil groove 14 is supplied to the spaces of the bush pieces 23 neighboring one another and is supplied from the spaces of the bush pieces 23 to the inner surface of each bush piece 23. That is, the oil supplied to the spaces of the bush pieces 23 is supplied to the inner surface of the bush pieces 23 arranged at the hydraulic pump unit 3 side and the inner surface of the bush pieces 23 arranged at the seal chamber 13 side.

The oil supplied to the inner surface of the bush pieces 22 is led into the bearing gap in a state of a wedge. The bearing gap becomes narrower in a rotational direction with the rotation of the drive shaft 25. The oil film pressure caused by the wedge action forms a satisfactory lubricating oil film so that the drive shaft 25 is smoothly supported.

The hydraulic oil led from the oil groove 14 into the seal chamber 13 is sealed by the seal member 46 encased in the seal chamber 13.

The sectional area of the oil groove 14 in the seal chamber 13 side is formed so as to be greater than the sectional area of the oil groove 14 in the hydraulic pump unit 3 side. The oil groove 14 leads the leakage oil from the hydraulic pump unit 3 to the seal chamber 13. Therefore, when the quantity of the leakage oil from the hydraulic pump unit 3 increases, the flow speed in the oil groove 14 in the hydraulic pump unit 3 side becomes slower than the flow speed in the seal chamber 3 side and the energy of the hydraulic oil led into the seal chamber 13 decreases.

Figure 4:
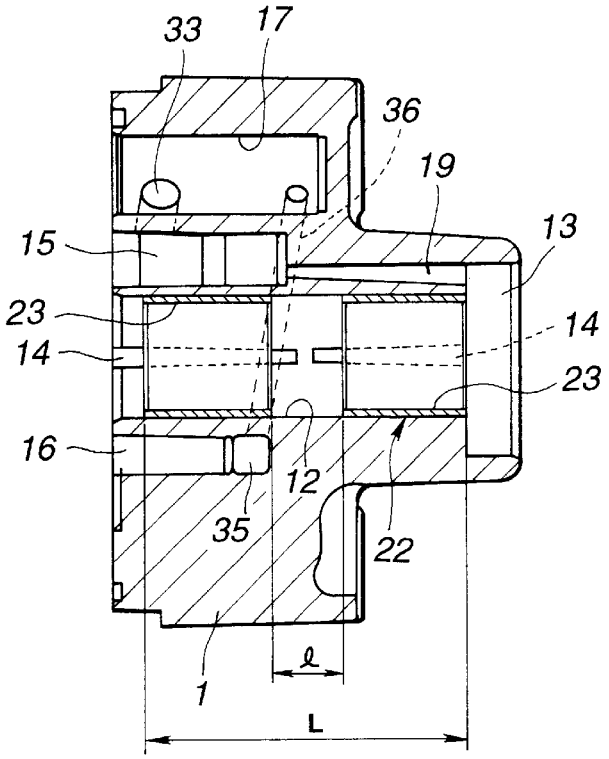
FIG. 4 is a sectional view of a pump body in a state that a bearing bush is inserted into a bearing hole.

Especially, in the embodiment shown in FIG. 4, the oil groove 14 is separated at a substantially center position of the bearing hole 12. The separated portion becomes the so-called labyrinth and gives the hydraulic oil flowing through the oil groove 14 a flow resistance and thereby being able to decrease the energy of the hydraulic oil flowing into the seal chamber 13.

Thus, because it is possible to prevent the energy of the hydraulic oil led into the seal chamber 13 from exceeding the sealing ability of the seal member 46, the seal member 46 securely seals the hydraulic oil in the seal chamber 13.

Therefore, it is possible to provide a hydraulic pump which can prevent the hydraulic oil from leaking to the outside.

When the drive shaft 25 drives the hydraulic pump unit 3, the drive shaft 25 is supported by the bearing bush 22. Because a moderate bearing gap is formed between the bearing bush 22 and the drive shaft 25, the drive shaft 25 can incline in the cylindrical bearing bush 22. This embodiment forms a stable lubricating oil film at both end sides of the bearing bush 22 and prevents an inferior lubrication without letting both end sides of the bearing bush 22 firmly contact the drive shaft 25.

That is, because the bearing bush 22 is formed in such a manner that a plurality of bush pieces 23 are positioned at the predetermined interval 1 in the axial direction of the bearing hole 12, a gap (the interval 1) is formed at a substantially center portion of the bearing bush 22. However, the bush pieces 23 are respectively arranged at both end sides of the bearing bush 22. The drive shaft 25 firmly contacts the end sides of the bearing bush 22. The oil groove preventing the lubricating oil film from being formed is not formed at the inner circumference of the bush pieces 23. The oil for lubricating is sufficiently supplied from both end sides of the bearing bush 22 and the bush pieces 23 neighboring with one another to the inner circumference of the bearing bush 22 comprised of each bush piece 23. Therefore, especially at both end sides of the bearing bush 22 the drive shaft 25 firmly contacts, the stable lubricating oil film is formed and the inferior lubrication is prevented.

Figure 7:
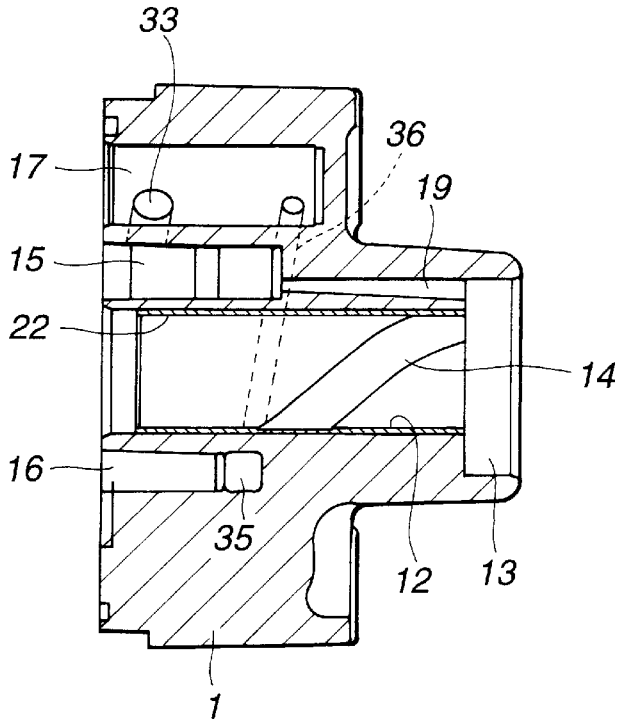
FIG. 7 is a view, similar to FIG. 4, showing another embodiment of the present invention.
Figure 8A:
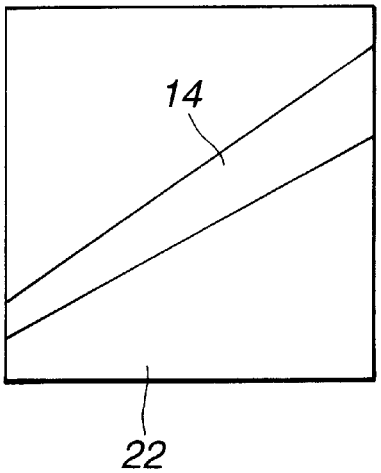
FIG. 8A is a view showing one oil groove of the bearing bush of FIG. 7 in an expanded state.
Figure 8B:
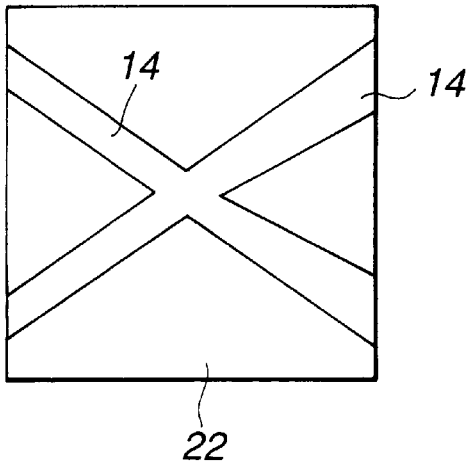
FIG. 8B is a view showing two oil grooves of the bearing bush of FIG. 7 in an expanded state.

FIGS. 7 and 8 show another embodiment of the present invention. In this embodiment, at the inner circumference of the bearing bush 22, the oil groove 14 is formed. The oil groove 14 connects the hydraulic pump unit 3 side with the seal chamber 13 and flows the hydraulic oil for lubrication.

That is, the bearing bush 22 is formed by rounding a plate member. At the inner circumference of this bearing bush 22, the oil groove 14 is formed. The oil groove 14 is obliquely formed as one straight line or two oil grooves 14 are formed so as to cross each other at a substantially center position in such a manner that the bearing bush 22 is expanded into a plate shape as shown in FIG. 8. Each oil groove 14 is formed in a taper shape so that each sectional area increases gradually from the hydraulic pump unit 3 side to the seal chamber 13 side.

Other compositions of this embodiment are substantially the same as compositions of the above-mentioned embodiment. Thus, the same composition has the same reference numeral and an overlapping explanation is omitted.

According to this constitution, the leakage oil led into the bearing hole 12 from the hydraulic pump unit 3 is directly supplied from the bearing hole 12 of the hydraulic pump unit 3 side into the inner surface of the bearing bush 22, is led into the seal chamber 13 through the oil groove 14 formed in the inner circumference of the bearing bush 22 and is supplied from the oil groove 14 and the seal chamber 13 side into the inner surface of the bearing bush 22. With this, the drive shaft 25 is smoothly supported.

The hydraulic oil led from the oil groove 14 into the seal chamber 13 is sealed by the seal member 46 encased in the seal chamber 13.

The sectional area of the oil groove 14 in the seal chamber 13 side is formed so as to be greater than the sectional area of the oil groove 14 in the hydraulic pump unit 3 side. The oil groove 14 leads the leakage oil from the hydraulic pump unit 3 to the seal chamber 13. Therefore, when the quantity of the leakage oil from the hydraulic pump unit 3 increases, the flow speed in the oil groove 14 in the hydraulic pump unit 3 side becomes slower than the flow speed in the seal chamber 3 side and the energy of the hydraulic oil led into the seal chamber 13 decreases. Thus, because it is possible to prevent the energy of the hydraulic oil led into the seal chamber 13 from exceeding the sealing ability of the seal member 46, the seal member 46 securely seals the hydraulic oil in the seal chamber 13.

Therefore, in this embodiment, it is possible to provide a hydraulic pump which can prevent the hydraulic oil from leaking to the outside.

Because the oil groove 14 is formed in the inner surface of the bearing bush 22, it is possible to decrease the manufacturing man-hour of the bearing hole 12.

Figure 9:
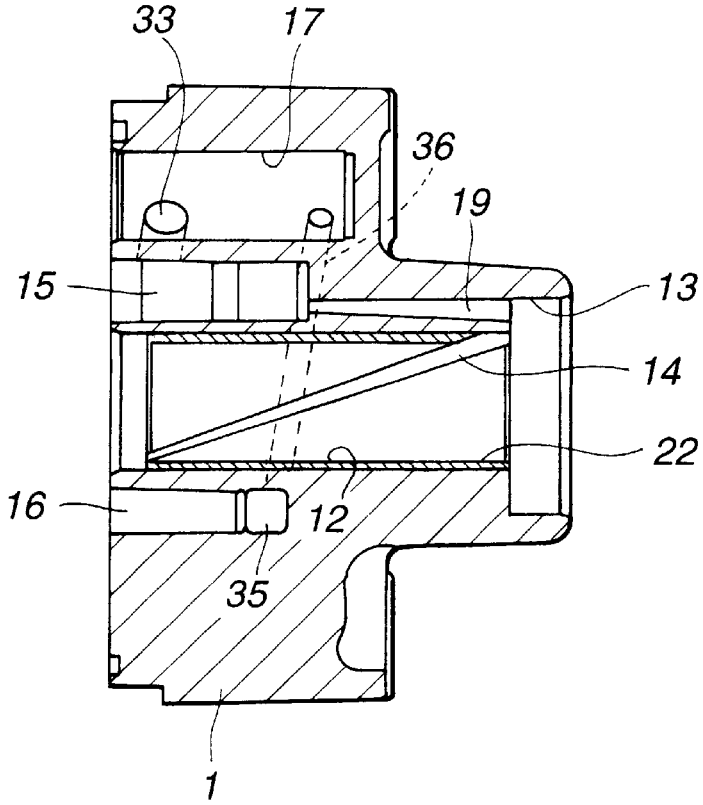
FIG. 9 is a view, similar to FIG. 4, showing another embodiment of the present invention.

FIG. 9 shows another embodiment of the present invention. In this embodiment, the bearing bush 22 is formed from a plate member by rounding into a cylindrical shape and the joint of the bearing bush 22 connects the hydraulic pump unit 3 side with the seal chamber 13 and forms the oil groove 14 flowing the hydraulic oil for lubrication.

That is, the oil groove 14 is formed in such a manner that opposite sides forming the joint are non-parallel in a state that the bearing bush 22 is expanded into a plate shape and the sectional area of the oil groove 14 in the seal chamber side is formed so as to be greater than the sectional area in the hydraulic pump unit. That is, the joint of the bearing bush 22 (bush pieces 23) in the above-mentioned embodiment are stuck without gaps. However, the joint of the bearing bush 22 in this embodiment is formed with the gap increasing gradually from the hydraulic pump unit 3 side to the seal chamber 13 side.

Other compositions of this embodiment are substantially the same as compositions of the above-mentioned embodiment. Thus, the same composition has the same reference numeral and an overlapping explanation is omitted.

According to this constitution, the leakage oil led into the bearing hole 12 from the hydraulic pump unit 3 is directly supplied from the bearing hole 12 of the hydraulic pump unit 3 side into the inner surface of the bearing bush 22, is led into the seal chamber 13 through the oil groove 14 formed by the joint of the bearing bush 22 and is supplied from the oil groove 14 and the seal chamber 13 side into the inner surface of the bearing bush 22. With this, the drive shaft 25 is smoothly supported.

The hydraulic oil led from the oil groove 14 into the seal chamber 13 is sealed by the seal member 46 encased in the seal chamber 13.

The sectional area of the oil groove 14 in the seal chamber 13 side is formed so as to be greater than the sectional area of the oil groove 14 in the hydraulic pump unit 3 side. The oil groove 14 leads the leakage oil from the hydraulic pump unit 3 to the seal chamber 13. Therefore, when the quantity of the leakage oil from the hydraulic pump unit 3 increases, the flow speed in the oil groove 14 in the hydraulic pump unit 3 side becomes slower than the flow speed in the seal chamber 3 side and the energy of the hydraulic oil led into the seal chamber 13 decreases. Thus, because it is possible to prevent the energy of the hydraulic oil led into the seal chamber 13 from exceeding the sealing ability of the seal member 46, the seal member 46 securely seals the hydraulic oil in the seal chamber 13.

Therefore, in this embodiment, it is possible to provide a hydraulic pump which can prevent the hydraulic oil from leaking to the outside.

Because the oil groove 14 is formed by the joint of the bearing bush 22, it is possible to decrease the manufacturing man-hour of the oil groove 14.

The above-mentioned description is an explanation of the embodiments of the present invention with reference to the drawings. The present invention is not limited to these embodiments. The present invention can change without departing from the spirit of the present invention. For example, the oil groove 14 formed inside the bearing hole 12 is formed in a substantially straight line in the axial direction of the bearing hole 12, but can be spiral or can be multiple threads.

The bush 22 can comprise more than three bush pieces. In this case, each of bush pieces can be positioned at an equal or unequal interval.

According to the present invention, it is possible to provide the hydraulic pump which can prevent the hydraulic oil from leaking to the outside.

What is claimed is:

1. A hydraulic pump, comprising:

a pump body formed with a bearing hole passing through the pump body;

a pump cover;

a hydraulic pump unit encased between the pump body and the pump cover;

a drive shaft, inserted into the bearing hole, for driving the hydraulic pump unit;

a bearing bush, inserted into the bearing hole, for supporting the drive shaft;

a seal member encased in a seal chamber formed at an end portion of the bearing hole; and an oil groove, formed in the bearing hole, for connecting a hydraulic pump unit's side with the seal chamber and for carrying hydraulic oil for lubrication;

wherein a sectional area of the oil groove is greater on a seal chamber's side than on the hydraulic pump unit's side, and wherein the bearing bush comprises a plurality of bush pieces arranged at a predetermined interval in an axial direction of the bearing hole.

2. A hydraulic pump as claimed in claim 1 wherein the bearing bush comprises two bush pieces positioned at the predetermined interval in the axial direction of the bearing hole and the oil groove is discontinuous at a position between the two bush pieces.

3. A hydraulic pump as claimed in claim 1 wherein the sectional area of the oil groove increases gradually from the hydraulic pump unit side to the seal chamber.

4. A hydraulic pump, comprising:

a pump body formed with a bearing hole passing through the pump body;

a pump cover;

a hydraulic pump unit encased between the pump body and the pump cover;

a drive shaft, inserted into the bearing hole, for driving the hydraulic pump unit;

a bearing bush, inserted into the bearing hole, for supporting the drive shaft;

a seal member encased in a seal chamber formed at an end portion of the bearing hole; and an oil groove, formed in an inner circumference surface of the bearing bush, for connecting a hydraulic pump unit's side with the seal chamber and for carrying hydraulic oil for lubrication;

wherein a sectional area of the oil groove is greater on the seal chamber's side than on the hydraulic pump unit's side.

5. A hydraulic pump as claimed in claim 4 wherein the oil groove is formed in such a manner that the sectional area increases gradually from the hydraulic pump unit's side to the seal chamber side.

6. A hydraulic pump, comprising:

a pump body formed with a bearing hole passing through the pump body;

a pump cover;

a hydraulic pump unit encased between the pump body and the pump cover;

a drive shaft, inserted into the bearing hole, for driving the hydraulic pump unit;

a bearing bush, inserted into the bearing hole, for supporting the drive shaft; and a seal member encased in a seal chamber formed at an end portion of the bearing hole;

wherein the bearing bush comprises a plate shape member rounded into a cylindrical shape, wherein the plate member comprises a gap forming an oil groove for connecting the hydraulic pump unit's side with the seal chamber and for carrying hydraulic oil for lubrication; and wherein a sectional area of the oil groove is greater on the seal chamber's side than on the hydraulic pump unit's side.

7. A hydraulic pump as claimed in claim 6 wherein the oil groove is formed in such a manner that the sectional area increases gradually from the hydraulic pump unit side to the seal chamber side.

8. A hydraulic pump assembly comprising:

a pump cover;

a pump body formed with a bearing hole extending from a first open end opening toward the pump cover and a second open end opening in a direction away from the pump cover, the pump body being further formed with a seal chamber surrounding the second open end of the bearing hole;

a hydraulic pump unit encased between the pump body and the pump cover;

a drive shaft received in the bearing hole, and connected with the pump unit, for driving the pump unit;

a seal member received in the seal chamber;

a bearing bush received in the bearing hole, for supporting the drive shaft;

wherein the hydraulic pump further comprises an oil groove formed in the bearing hole by at least one of the pump body and the bearing bush, the oil groove extending from a first point to a second point at which the oil groove opens into the seal chamber, the oil groove being tapered from the second point toward the first point in such a manner that a sectional size of the oil groove becomes gradually smaller from the second point toward the first point which is remoter from the second end of the bearing hole than the second point is.

9. The hydraulic pump assembly according to claim 8 wherein the oil groove comprises a second side groove section tapering from the second point to a middle point between the first and second open ends of the bearing hole.

10. The hydraulic pump assembly according to claim 9 wherein the bearing bush comprises a plurality of bush pieces which are axially spaced from one another along an axial direction of the bearing hole, and the oil groove is formed in an inside cylindrical surface of the pump body defining the bearing hole.

11. The hydraulic pump assembly according to claim 10 wherein the bearing bush consists of two of the bush pieces, and the oil groove further comprises a first side groove section extending from the first open end of the bearing hole toward the middle point between the first and second open ends of the bearing hole, the first and second side groove sections are discontinuous at the middle point located in an annular space between the two bush pieces.

12. The hydraulic pump assembly according to claim 10 wherein the oil groove extends from a first groove end located at the first open end of the bearing hole to a second groove end opening to the seal chamber, and the oil groove is tapered from the second groove end to the first groove end so that the sectional size of the oil groove becomes gradually smaller from the second groove end to the first groove end.

13. The hydraulic pump assembly according to claim 9 wherein the bearing bush extends from a first axial bush end facing toward the pump unit to a second axial bush end facing to the seal chamber, the oil groove is formed in an inside surface of the bearing bush, and the oil groove extends from the first bush end to the second bush end.

14. The hydraulic pump assembly according to claim 13 wherein the oil groove extends helically around an axis of the bearing hole.

15. The hydraulic pump assembly according to claim 9 wherein the bearing bush includes a plate which is formed in a cylindrical shape, and which comprises two opposite edges confronting each other, the oil groove is formed between the two opposite edges of the plate, and the oil groove comprises a groove bottom formed by the inside cylindrical surface of the pump body.

16. The hydraulic pump assembly according to claim 8, wherein the oil groove comprises a first and second oil grooves formed in the bearing hole so as to cross each other at a substantially middle point between the first point and the second point.

17. The hydraulic pump assembly according to claim 9, wherein the oil groove comprises a first side groove section tapering from the first point to the middle point between the first and second open ends of the bearing hole, and wherein the first and second side groove sections are connected at the middle point.

* * * * *